United States Patent [19]

Beuther et al.

[11] 4,139,452

[45] Feb. 13, 1979

[54] PROCESS FOR PRODUCING BENZENE

[75] Inventors: Harold Beuther, Gibsonia; Angelo A. Montagna, Monroeville, both of Pa.

[73] Assignee: Gulf Research & Development Company, Pittsburgh, Pa.

[21] Appl. No.: 816,602

[22] Filed: Jul. 18, 1977

Related U.S. Application Data

[63] Continuation-in-part of Ser. No. 688,106, May 19, 1976, abandoned.

[51] Int. Cl.[2] ..... C10G 13/24; C10G 13/26; C07C 15/04

[52] U.S. Cl. ..... 208/107; 208/126; 260/668 R; 260/672 NC

[58] Field of Search ..... 208/107, 108, 133, 126–127; 260/668 R, 672 NC, 668 F

[56] References Cited

U.S. PATENT DOCUMENTS

| | | | |
|---|---|---|---|
| 2,381,522 | 8/1945 | Stewart | 208/107 |
| 2,388,937 | 11/1945 | Schmerling et al. | 260/668 R |
| 2,674,635 | 4/1954 | Beckberger | 260/672 NC |
| 2,885,337 | 5/1959 | Keith et al. | 208/8 |
| 3,030,297 | 4/1962 | Schroeder | 208/8 |
| 3,145,238 | 8/1964 | Kestner | 260/672 NC |
| 3,178,272 | 4/1965 | Dent et al. | 208/59 X |
| 3,210,432 | 10/1965 | Richter | 260/668 R |

*Primary Examiner*—Delbert E. Gantz
*Assistant Examiner*—G. E. Schmitkons

[57] ABSTRACT

A process for preparing benzene which involves heating a selected hydrocarbon stock containing condensed polynuclear aromatic rings in the presence of hydrogen under critical reaction conditions.

5 Claims, No Drawings

PROCESS FOR PRODUCING BENZENE

This application is a continuation-in-part application of our U.S. Patent Application Ser. No. 688,106, filed May 19, 1976, entitled "Process for Producing Benzene," now abandoned.

BACKGROUND OF THE INVENTION

1. Field of the Invention

This invention relates to a process for converting a selected hydrocarbon stock containing substantial amounts of condensed polynuclear aromatic rings to a product containing significant amounts of benzene.

2. Description of the Prior Art

Hydrocarbon stocks have been subjected to treatment at elevated temperatures in the presence of hydrogen to obtain lower-molecular weight hydrocarbons, but the reactions described have not resulted in the production of reaction products containing substantial amounts of benzene. Such processes are described in U.S. Pat. Nos. 2,875,150 to Schuman, 2,885,337 to Keith et al and 3,178,272 to Dent et al.

SUMMARY OF THE INVENTION

We have found that we can obtain a product containing a substantial amount of benzene from a hydrocarbon stock by heating the same in the presence of hydrogen under critical reaction conditions. The hydrocarbon charge stock used herein is selected from the group consisting of FCC Furnace Oils, FCC Decanted Oils and coal liquids derived from the hydrogenation of coal. By "FCC Furnace Oil" we mean to include the product from a conventional fluid catalytic cracking process having a boiling point range at ambient pressure of about 220° to about 345° C., and by FCC Decanted Oil we mean to include the product from a conventional fluid catalytic cracking process having a boiling point range at ambient pressure of about 345° to about 510° C.

The process is simply carried out by heating the hydrocarbon charge defined above in the presence of hydrogen, preferably by passing the mixture through a non-catalytic bed composed, for example, of particulate material, such as bauxite, sand, zircon, quartz, magnesia, alumina, magnesia-alumina, silica-alumina, etc. However, the conditions needed to convert the defined charge to a product containing substantial amounts of benzene are critical.

The average temperature in the reaction zone must be within the range of about 650° to about 1100° C., preferably within the range of about 700° to about 930° C. By "average temperature" we mean the volume average temperature of the fraction of the reactor which is above 650° C. In addition, it is necessary that the temperature in the reaction zone reach a minimum level of 700° C., preferably about 760° C. The total pressure in the reaction zone must be between about 800 to about 2500 pounds per square inch gauge (about 56 to about 175 kilograms per square centimeter), preferably in the range of about 900 to about 2000 pounds per square inch gauge (about 63 to about 140 kilograms per square centimeter). The hydrogen partial pressure must be within the range of about 500 to about 2000 pounds per square inch gauge (about 35 to about 140 kilograms per square centimeter), preferably about 800 to about 1600 pounds per square inch gauge (about 56 to about 112 kilograms per square centimeter). By "hydrogen partial pressure" we mean the total pressure in the reactor multiplied by the mol fraction of hydrogen in the gas feed. When the sole gas in the reaction system is hydrogen, then the hydrogen partial pressure and total pressure will be the same. The hydrogen ratio must be at least about 0.5, preferably in the range of about 1.0 to about 3.0. By "hydrogen ratio" we mean the ratio of hydrogen in the gas feed to that theoretically required for substantially complete conversion of all of the carbon in the liquid feed to methane. The residence time must be at least three seconds but no more than about 120 seconds, preferably at least about four seconds but no more than about 45 seconds. Although these conditions, as set forth above, are critical in order to maximize the amount of benzene produced, it is understood that best results are obtained by a close correlation of the above parameters, one with the other, than can easily be determined in practice.

By following the above dictates we have found that, per pass, the benzene yield is at least about 14 weight percent based on the hydrocarbon feed, but in general the benzene yield based on the hydrocarbon feed ranges from about 16 to about 50 weight percent. Substantially all of the benzene produced is obtained as a result of the conversion of the condensed polynuclear aromatic compounds in the charge. The benzene and the remaining individual liquid components can be recovered from the reaction product in any suitable manner, for example, by fractionation, after the gaseous products have been previously removed from the reaction product by reducing the pressure thereon and venting.

DESCRIPTION OF PREFERRED EMBODIMENTS

A number of runs was carried out in which various feeds, together with hydrogen, were passed downwardly through a reactor to obtain a product containing benzene. The reactor was 13⅝ inches (34.6 centimeters) long, ½-inch (1.27 centimeters) inner diameter, had a total volume of 2.51 cubic inches (41.2 cubic centimeters) and contained a ⅛-inch (0.318 centimeter) thermowell down the center. The reactor was packed with −10 to +20 mesh quartz packing and had a void volume of 1.10 cubic inches (18.1 cubic centimeters). The charge stocks used were a FCC Decanted Oil, a FCC Furnace Oil and coal liquids obtained from the hydrogenation of a Big Horn coal, the coal liquids (A) and (B) having a boiling range at atmospheric pressure of 316° to 343° C. and 232° to 426° C., respectively. The properties of the feedstocks used are set forth below in Table I.

TABLE I

| | FCC Decanted Oil | FCC Furnace Oil | Coal Liquids A | Coal Liquids B |
|---|---|---|---|---|
| Gravity, ° API[1] | 8.1 | 12.1 | 2.10 | 0.0 |
| Elemental Analysis, Weight Per Cent | | | | |
| Carbon | 89.88 | 91.27 | 90.48 | 90.48 |
| Hydrogen | 9.04 | 8.50 | 7.40 | 6.94 |
| Oxygen | 0.14 | 0.10 | 1.60 | 1.60 |

TABLE I-continued

| | FCC Decanted Oil | FCC Furnace Oil | Coal Liquids A | Coal Liquids B |
|---|---|---|---|---|
| Nitrogen | 0.12 | 0.014 | 0.43 | 0.60 |
| Sulfur | 0.93 | 0.48 | 0.15 | 0.14 |
| Hydrocarbon Analysis, Volume Percent | | | | |
| Aromatics | 91.3[2] | 98.0[2] | 98.7[2] | 66[6] |
| Saturates | 8.7 | 2.0 | 1.3 | 30 |
| Benzene, Weight Per Cent of Aromatic Fraction | 2.1 | 1.1 | 0.4 | — |
| Asphalthenes, Weight Per Cent | 0.42 | 0.13 | 0.61 | 1.49 |
| Carbon Residue, Weight Per Cent[3] | 3.34 | 0.10 | 0.34 | 0.70 |
| Distillation | | | | |
| 10 Per Cent | 310° C[4] | 250° C[5] | Not Taken | 334° C[4] |
| 50 Per Cent | 384° C | 265° C | Not Taken | 448° C |
| 90 Per Cent | 442° C[6] | 298° C | Not Taken | 524° C |

[1]ASTM D-180
[2]ASTM D-1319
[3]ASTM D-189
[4]ASTM D-1160
[5]ASTM D-86
[6]Cracked at 80%; distillation to 80% given It can be seen that there was very little benzene in the feed stocks. Upon completion of the runs, the reaction product obtained was analyzed and the data obtained are set forth in the tables below.

TABLE II

Hydrogenation of FCC Furnace Oil

| Run No. | 1 | 2 | 3 | 4 | 5 | 6 | 7 |
|---|---|---|---|---|---|---|---|
| Liquid Feed Rate (Grams Per Hour) | 16.8 | 34 | 41.2 | 40.1 | 41.3 | 8.6 | 16.6 |
| Total Gas Feed (Liters Per Hour At STP) | 125 | 250 | 323 | 323 | 323 | 162 | 323 |
| Hydrogen Concentration In Gas, Mol Per Cent[1] | 100 | 100 | 100 | 100 | 100 | 40 | 40 |
| Total Reactor Pressure, PSI (Kg/Cm$^2$) | 1500 (105) | 1500 (105) | 1200 (84) | 900 (63) | 600 (42) | 1500 (105) | 1500 (105) |
| Partial Pressure Of Hydrogen In Feed, PSI (Kg/Cm$^2$) | 1500 (105) | 1500 (105) | 1200 (84) | 900 (63) | 600 (42) | 600 (42) | 600 (42) |
| Residence Time, Seconds | 16 | 7 | 3 | 2 | 1 | 3 | 1 |
| Hydrogen Ratio | 2.9 | 2.8 | 3.0 | 3.1 | 3.0 | 2.9 | 3.0 |
| Average Reactor Temperature, ° C | 774 | 774 | 774 | 774 | 774 | 774 | 774 |
| Maximum Temperature Reached, ° C | 843 | 843 | 843 | 843 | 843 | 843 | 843 |
| Product Yields, Per Cent By Weight Based On Liquid Feed | | | | | | | |
| Benzene | 18.1 | 24.2 | 22.4 | 9.9 | 4.9 | 14.9 | 3.5 |
| Toluene | 0.4 | 0.6 | 0.3 | 0.2 | 0.3 | 0.5 | 0.1 |
| Xylenes And/Or Ethylbenzenes | 0.2 | 0.2 | 0.1 | — | — | — | 0.1 |
| Naphthalenes | 12.3 | 24.0 | 13.1 | 19.0 | 32.3 | 9.8 | 9.3 |
| Anthracene And/Or Phenanthrene | 0.5 | 0.5 | 0.5 | 6.8 | 2.9 | 0.4 | 3.0 |
| Methane | 61.2 | 41.4 | 46.4 | 49.4 | 35.0 | 2 | 2 |
| Ethane And/Or Ethylene | 17.8 | 15.8 | 19.8 | 23.7 | 21.3 | 40.6 | 44.5 |

[1]Balance is methane
[2]Large quantity of methane in feed makes material balance exceedingly difficult

TABLE III

Hydrogenation of Coal Liquids

| Run No. | Coal Liquids A | | | | | | Coal Liquids B | | | | | | |
|---|---|---|---|---|---|---|---|---|---|---|---|---|---|
| Run No. | 8 | 9 | 10 | 11 | 12 | 13 | 14 | 15 | 16 | 17 | 18 | 19 | 20 |
| Liquid Feed Rate (Grams Per Hour) | 34.1 | 67.0 | 68.0 | 36.0 | 33.5 | 16.7 | 36.7 | 18.4 | 36.6 | 17.0 | 35.5 | 22.9 | 8.88 |
| Hydrogen Feed Rate (Liters Per Hour At STP)[1] | 125 | 250 | 500 | 500 | 250 | 125 | 250 | 125 | 250 | 125 | 250 | 75 | 30 |
| Total Reactor Pressure, PSI (Kg/Cm$^2$) | 1500 (105) | 1500 (105) | 1500 (105) | 1500 (105) | 1500 (105) | 1500 (105) | 1500 (105) | 1500 (105) | 1500 (105) | 750 (53) | 1500 (105) | 1500 (105) | 1500 (105) |
| Residence Time, Seconds | 14 | 7 | 3 | 3 | 7 | 15 | 6 | 15 | 5 | 7 | 7 | 25 | 39 |
| Hydrogen Ratio | 1.4 | 1.4 | 2.8 | 1.4 | 2.8 | 2.8 | 2.5 | 2.5 | 2.5 | 2.7 | 2.6 | 1.2 | 1.2 |
| Average Reactor Temperature, ° C | 774 | 774 | 774 | 774 | 774 | 774 | 774 | 774 | 691 | 774 | 774 | 774 | 774 |
| Maximum Temperature Reached, ° C | 843 | 843 | 846 | 849 | 843 | 845 | 843 | 843 | 704 | 843 | 843 | 846 | 843 |
| Product Yields, Per Cent By Weight Based on Liquid Feed | | | | | | | | | | | | | |
| Benzene | 31.2 | 34.0 | 26.5 | 25.6 | 23.8 | 25.0 | 35.8 | 28.7 | 7.7 | 4.2 | 30.0 | 50.2 | 17.6 |
| Toluene | 6.4 | 1.3 | 1.1 | 1.5 | 0.8 | 0.4 | 0.3 | 0.2 | — | — | 1.0 | 0.5 | 0.4 |
| Xylenes And/Or Ethylbenzenes | 1.2 | 1.5 | 0.1 | 0.1 | 0.1 | 0.1 | — | — | — | — | 0.1 | 0.1 | — |
| Naphthalenes | 21.2 | 26.5 | 28.7 | 29.5 | 20.0 | 14.3 | 10.0 | 2.9 | 23.1 | 22.5 | 22.3 | 6.8 | 2.2 |
| Anthracene And/Or Phenanthrene | 4.6 | 7.1 | 7.6 | 8.9 | 7.0 | 3.4 | 1.0 | 0.6 | 29.1 | 20.9 | 11.7 | 0.7 | 1.1 |
| Methane | 40.5 | 24.0 | 30.4 | 22.3 | 34.6 | 40.9 | Not Taken | 61.4 | 10.8 | 32.7 | 29.6 | 23.2 | 91.0 |
| Ethane And/Or Ethylene | 11.6 | 10.3 | 15.6 | 11.4 | 15.6 | 13.2 | Not Taken | 16.5 | 10.9 | 8.9 | 11.8 | 2.0 | 9.1 |

[1]Gas feed is all hydrogen

TABLE IV

| Hydrogenation of FCC Decanted Oil | | | |
|---|---|---|---|
| Run No. | 21 | 22 | 23 |
| Liquid Feed Rate (Grams Per Hour) | 17.2 | 33.7 | 67.0 |
| Hydrogen Feed Rate (Liters Per Hour At STP)[1] | 125 | 250 | 500 |
| Total Reactor Pressure, PSI (Kg/Cm$^2$) | 1500 (105) | 1500 (105) | 1500 (105) |
| Residence Time, Seconds | 12 | 6 | 2 |
| Hydrogen Ratio | 2.9 | 3.0 | 3.0 |
| Average Reactor Temperature, ° C | 774 | 774 | 774 |
| Maximum Temperature Reached, ° C | 843 | 843 | 846 |
| Product Yields, Per Cent By Weight Based On Liquid Feed | | | |
| Benzene | 19.5 | 23.6 | 9.5 |
| Toluene | 0.2 | 0.5 | 0.6 |
| Xylenes And/Or Ethylbenzenes | — | — | — |
| Naphthalenes | 6.7 | 14.7 | 15.4 |
| Anthracene And/Or Phenanthrene | 1.3 | 5.8 | 13.2 |
| Methane | 57.0 | 51.8 | 33.5 |
| Ethane And/Or Ethylene | 20.6 | 18.6 | 21.1 |

[1]Gas feed is all hydrogen

The data in Tables II, III and IV above amply demonstrates the criticality of operating within the defined limits herein to obtain a product containing large amounts of benzene. Thus, when the reaction conditions defined herein were strictly maintained in the treatments of the defined charges in each of Runs Nos. 1 to 3, 6, 8 to 15 and 18 to 22 excellent yields of benzene were obtained. When operation in Runs Nos. 4 (residence time too low), 5 (total pressure and residence time too low), 7 (residence time too low), 16 (maximum reactor temperature too low), 17 (total reactor pressure too low) and 23 (residence time too low), was outside of the defined critical limits, the benzene yields were low.

Obviously, many modifications and variations of the invention, as hereinabove set forth, can be made without departing from the spirit and scope thereof and, therefore, only such limitations should be imposed as are indicated in the appended claims.

We claim:

1. A process for preparing benzene from a hydrocarbon stock selected from the group consisting of FCC Furnace Oils, FCC Decanted Oils and coal liquids derived from the hydrogenation of coal, which comprises heating such hydrocarbon stock, together with hydrogen, in a non-catalytic bed at least to a temperature of about 700° C. while maintaining an average reaction temperature of about 650° to about 1100° C., a total pressure of about 800 to about 2500 pounds per square inch gauge, a hydrogen partial pressure of about 500 to about 2000 pounds per square inch, with the ratio of the hydrogen in the gas feed to that theoretically required for substantially complete conversion of all of the carbon in the liquid feed to methane being at least about 0.50 and a residence time of three to about 120 seconds.

2. The process of claim 1 wherein the hydrocarbon stock and hydrogen are heated to a temperature of about 760° C., the average reactor temperature is about 700° to about 930° C., the total pressure is in the range of about 900 to about 2000 pounds per square inch gauge, the hydrogen partial pressure is about 800 to about 1600 pounds per square inch, the ratio of hydrogen in the gas feed to that theoretically required for substantially complete conversion of all of the carbon in the liquid feed to methane is about 1.0 to about 3.0 and the residence time about four to about 45 seconds.

3. The process of claim 1 wherein the charge stock is a FCC Furnace Oil.

4. The process of claim 1 wherein the charge stock is a FCC Decanted Oil.

5. The process of claim 1 wherein the charge stock is coal liquid obtained from the hydrogenation of coal.

* * * * *

UNITED STATES PATENT AND TRADEMARK OFFICE

Certificate

Patent No. 4,139,452 Patented February 13, 1979

Harold Beuther and Angelo A. Montagna

Application having been made by Harold Beuther and Angelo A. Montagna, the inventors named in the patent above identified, for the issuance of a certificate under the provisions of Title 35, Section 256, of the United States Code, adding the names of Herman N. Woebcke, Joseph J. Williams and Paul E. Koppel as joint inventors, and a showing and proof of facts satisfying the requirements of the said section having been submitted, it is this 20th day of May 1980, certified that the names of the said Herman N. Woebcke, Joseph J. Williams and Paul E. Koppel are hereby added to the said patent as joint inventors with the said Harold Beuther and Angelo A. Montagna.

FRED W. SHERLING,
*Associate Solicitor.*